US007406791B2

(12) United States Patent
Lienau

(10) Patent No.: US 7,406,791 B2
(45) Date of Patent: Aug. 5, 2008

(54) SYSTEM AND METHOD OF DISPLAYING A NOTICE TAG FOR OUT-OF-SERVICE EQUIPMENT

(76) Inventor: William A. Lienau, 9233 E. Palm Tree Dr., Scottsdale, AZ (US) 85255

( * ) Notice: Subject to any disclaimer, the term of this patent is extended or adjusted under 35 U.S.C. 154(b) by 442 days.

(21) Appl. No.: 10/922,327

(22) Filed: Aug. 19, 2004

(65) Prior Publication Data

US 2006/0037224 A1 Feb. 23, 2006

(51) Int. Cl.
*G09F 3/10* (2006.01)

(52) U.S. Cl. ..... 40/673; 40/331; 116/200

(58) Field of Classification Search ..... 40/331, 40/310, 673; 116/200
See application file for complete search history.

(56) References Cited

U.S. PATENT DOCUMENTS 1,853,622 A * 4/1932 Kennedy ..... 281/29
2,059,009 A * 10/1936 McCarthy ..... 116/200
2,467,908 A * 4/1949 Rand ..... 248/475.1
5,249,380 A * 10/1993 Fast ..... 40/672
5,555,655 A * 9/1996 Yager et al. ..... 40/306
5,651,388 A * 7/1997 Farnan, Jr. ..... 137/551
5,826,356 A * 10/1998 Lapp ..... 40/310
6,196,593 B1 * 3/2001 Petrick et al. ..... 283/81
6,260,507 B1 * 7/2001 Simpson et al. ..... 116/200

* cited by examiner

*Primary Examiner*—Gary C Hoge
(74) *Attorney, Agent, or Firm*—Robert D. Atkins; Quarles & Brady LLP

(57) ABSTRACT

A notice tag marks out-of-service equipment, such as a fire hydrant. A front flat portion of the notice tag has an opening for mounting to the equipment. The opening may have a lip to pressure fit to a surface of the equipment, and a key for proper orientation to the notice. The front portion has an out-of-service notice on a colored background. A side portion or side panels are formed to the front portion at an angle greater than 90 degrees with respect to the front portion. The side panels are marked for visibility from a line of sight to the side panels. The side panels are marked with a geometric shape, such as red strips on a white background. The side panels may have a source of light for dark conditions. The side portion may extend around a circumference of the front portion.

11 Claims, 6 Drawing Sheets

FIG. 1
PRIOR ART
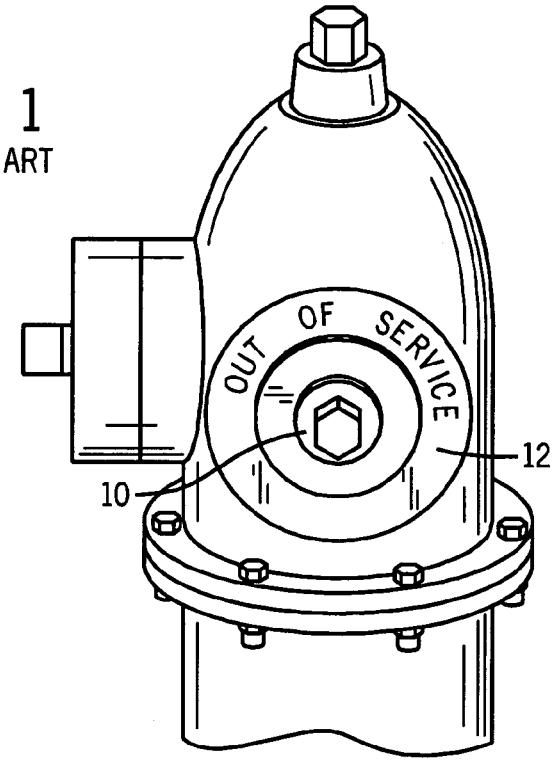
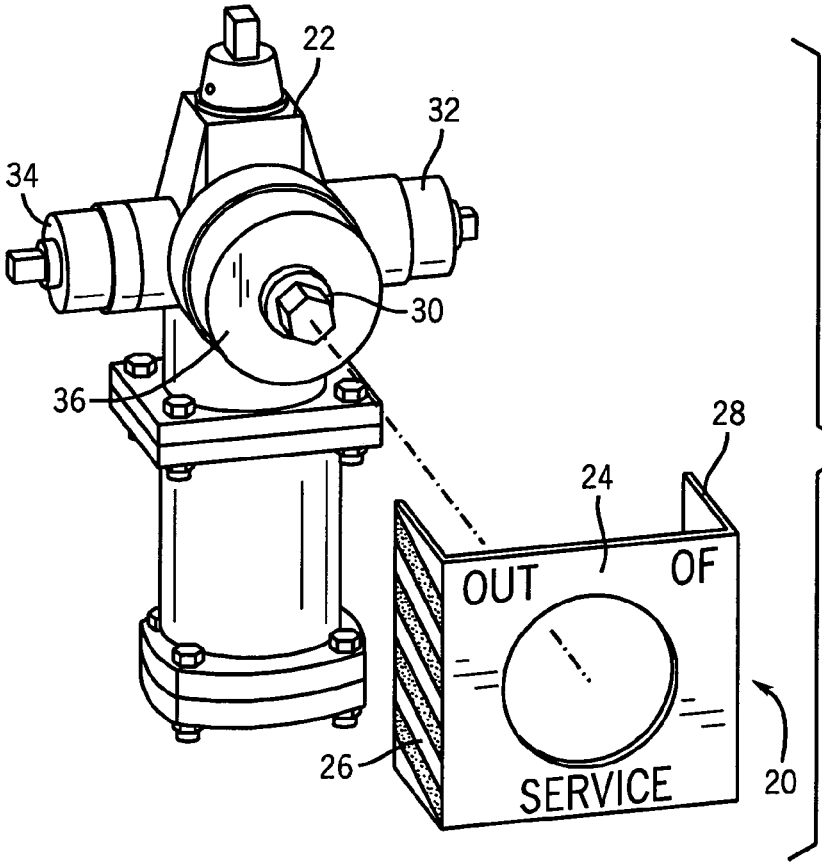
FIG. 2

SYSTEM AND METHOD OF DISPLAYING A NOTICE TAG FOR OUT-OF-SERVICE EQUIPMENT

FIELD OF THE INVENTION

The present invention relates in general to notification tags and, more particularly, to a system and method of displaying a notice tag for out-of-service equipment.

BACKGROUND OF THE INVENTION

Most if not all types of equipment are subject to down-time and periods of being out-of-service. Sometimes the equipment is malfunctioning; other times the equipment is taken down for routine preventative maintenance. Examples of the types of equipment subject to down-time include electrical utilities, water utilities, and public safety equipment. In the case of certain public safety equipment, such as fire hydrants and water outlets, which are found along many streets and attached to buildings, the equipment may be taken out of service because of faulty valves, leaks, or lack of water supply.

It is important to know when a fire hydrant is out of service. If a particular fire hydrant is not functional, the fire department would want to know that information in an emergency situation. Precious response time is lost if the fire truck comes to a stop by a fire hydrant and connects the fire hose only to discover that the unit is out of service when the valve is opened and no water flows.

To help fire fighting crews, water department maintenance workers often place out-of-service notice tags on non-functioning fire hydrants. The notification tag is typically a flat circular or rectangular card with a large opening in the middle, see FIG. 1. The threaded cap 10 over the fire hydrant fitting is removed and the out-of-service tag 12 is placed over the fitting. The cap is replaced to securely hold the tag in place. The tag may be colored red and displayed with a notice such as "out-of-service".

When a fire truck is responding to a fire, the on-board crew will observe a fire hydrant as they approach the working area of the fire. Generally, the truck will not stop, but rather will slow down enough to allow one or more fire fighters to jump off the back with the fire hose in-tow. The fire fighters will connect the hose to the fire hydrant while the truck continues a short distance to the fire, deploying the fire hose as it goes.

If the fire hydrant happens to be out of service, the flat notice tag placed over the fitting would likely not be visible from the approaching fire truck because the tag faces the street. The flat tag is difficult to observe from the side, which is the viewing angle available to the on-board fire crew as the truck approaches the fire hydrant. It is even more difficult to see the flat tag from the side at night and during inclement weather as the truck approaches at high speed.

Consequently, if the driver does not see the notice tag by the time the fire fighter jumps off, the hose may be deployed before the fire fighters become aware of the out-of-service condition of the fire hydrant. Valuable response time is wasted as the crew attempts to re-group and find another functioning fire hydrant.

A need exists to display notice tags for out-of-service equipment which are viewable from convenient angles.

SUMMARY OF THE INVENTION

In one embodiment, the present invention is a notice tag for marking a fire hydrant as being out-of-service comprising a rectangular tag having a flat portion with an opening adapted for mounting over a hose fitting of the fire hydrant. The notice tag further has side panels formed from first and second sides of the tag at an angle greater than 90 degrees with respect to a side of the flat portion facing the fire hydrant. The side panels are marked for visibility from a line of sight substantially normal to the side panels.

In another embodiment, the present invention is a notice tag for marking out-of-service equipment comprising a front portion with an opening. A side portion is formed to the front portion of the notice tag. The side portion is marked for visibility from a line of sight to the side portion.

In another embodiment, the present invention is a notice tag for marking equipment comprising a side portion adapted for mounting to a front portion of the notice tag. The side portion is marked for visibility from a line of sight to the side portion.

In another embodiment, the present invention is a notice tag for marking equipment comprising a front portion and a side portion integrated to the front portion of the notice tag at an angle greater than 90 degrees with respect to the front portion. The side portion is marked for visibility from a line of sight to the side portion.

In another embodiment, the present invention is an apparatus for marking equipment comprising a notice tag molded from a front portion to a side portion. The side portion is marked for visibility from a line of sight to the side portion.

BRIEF DESCRIPTION OF THE DRAWINGS

FIG. 1 illustrates a known notice tag placed on a fire hydrant;

FIG. 2 illustrates a notice tag with side panels for mounting on a fire hydrant;

DETAILED DESCRIPTION OF THE DRAWINGS

Figure 3:
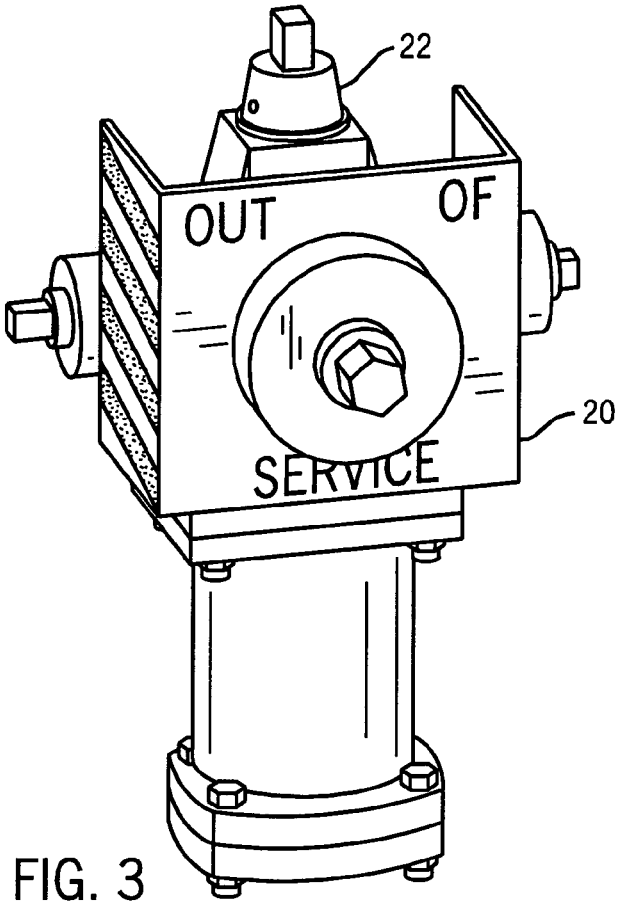
FIG. 3 illustrates the notice tag with side panels mounted to the fire hydrant.

The present invention is described in one or more embodiments in the following description with reference to the Figures, in which like numerals represent the same or similar elements. While the invention is described in terms of the best mode for achieving the invention's objectives, it will be appreciated by those skilled in the art that it is intended to cover alternatives, modifications, and equivalents as may be included within the spirit and scope of the invention as defined by the appended claims and their equivalents as supported by the following disclosure and drawings.

Many types of equipment are subject to down-time and out-of-service condition at one time or another. The equipment may include electrical utilities, water utilities, and public safety equipment. Sometimes the equipment is malfunctioning; other times the equipment is taken down for routine preventative maintenance. In one example, fire hydrants and water outlets, which are found along many streets and attached to buildings, may be out-of-service because of faulty valves, leaks, or lack of water supply.

It is important to provide notification for the fire department and maintenance crews as to which fire hydrant(s) are not in-service. By the process of counter-indication, the crews will know which ones are in-service. In one embodiment of the present invention, a notice tag 20 is designed to be placed on fire hydrant 22 as shown in FIG. 2. Notice tag 20 has front body or face 24 with side panels or flaps 26 and 28 on each side of the front face. Front face 24 has an opening which slides over the hose fitting of fire hydrant 22. Side panels 26 and 28 are visible from side viewing angles to aid water utility maintenance crews and fire truck crews to identify fire hydrants which are non-functional or otherwise not in service.

In FIG. 2, fire hydrant 22 has a front port 30 and side ports 32 and 34. Fire hoses can be connected to any of the fire hydrant ports. Generally, the opening of front port 30 faces the street, normal to the flow of traffic. The openings of side ports 32-34 are positioned at right angles with respect to front port 30, parallel to the flow of traffic. The common practice is to place any out-of-service notice tag on the front port of fire hydrant 22 facing the street.

The city water department or fire department may be charged with maintaining the operational status of the city's fire hydrants. Sometimes a fire hydrant must be taken out of service for faulty valve or leak. Other times, the water department may be working on water mains which cut off water supply to one or more fire hydrants. The fire hydrant may be out of service for days or weeks. The water department places a notice tag on the out-of-service fire hydrants so that, in an emergency response situation, the fire department knows which fire hydrants are not in service and, correspondingly, by counter-indication, which fire hydrants are in service. It is counterproductive for the fire department to waste valuable response time in trying to use a non-functional fire hydrant, or trying to locate a functional one, without some type of readily seen notice.

Assume the water department or fire department decides to take fire hydrant 22 out of service. Cap 36 of front port 30 of fire hydrant 22 is removed and notice tag 20 is placed over the hose fitting. Notice tag 20 is oriented such that side panels 26 and 28 are substantially vertical and visible from both sides of fire hydrant 22. The vertical orientation of side panels 26-28 makes notice tag 20 visible from side viewing angles to on-coming traffic. Cap 36 is replaced and tightened against notice tag 20 to prevent it from rotating.

FIG. 3 illustrates fire hydrant 22 with notice tag 20 in place. The side panels of notice tag 20 are substantially vertical and visible from either side of fire hydrant 22. In an emergency response situation, when a fire truck is approaching fire hydrant 22, the side panels of notice tag 20 are visible and observable to the truck's on-board crew from some distance away. Whereas a flat notice tag facing the street would likely have been difficult to see and potentially overlooked, particularly at night and in inclement weather, notice tag 20 with side panels 26 and 28 stands out and is readily seen from a variety of side viewing angles.

The side panels 26-28 of notice tag 20 are particular noticeable from either side of fire hydrant 22, i.e., from the viewing angle most likely seen by an approaching vehicle. That is, either the side panel 26 or 28 will be in the line of sight of the on-board crew on the approaching fire truck. The on-board crew of the fire truck is able to make the time-critical decision whether the up-coming fire hydrant is in service or out of service before the fire fighter jumps off the back of the truck and begins to deploy the fire hose. If fire hydrant 22 displays notice tag 20 with side panels 26 and 28, then the fire truck crew will know to continue to the next fire hydrant, possibly without even slowing down. Side panels 26 and 28 make notice tag 20 visible from either side for one-way streets or when looking across a two-way street.

Figure 4:
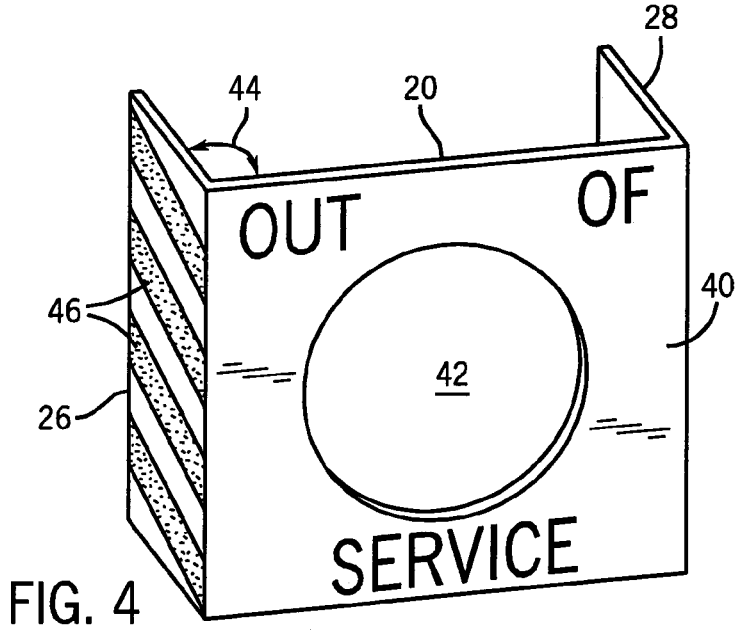
FIG. 4 illustrates further detail of the notice tag with side panels.

Further details of notice tag 20 are shown in FIG. 4. Notice tag 20 is made of plastic, graphite, fiberglass, polyethylene, polymer, or other durable material to withstand outside elements, e.g., sun, rain, heat, cold, snow, fog, and harsh chemical exposure. Notice tag 20 is corrosion resistant and flexible. If a pedestrian or bystander should bump into notice tag 20, it is desirable for safety reasons for the tag to give but not break. Notice tag 20 has front face 40 which is painted red or other noticeable color or design. Front face 40 includes text and information such as "OUT OF SERVICE" or "NOT IN SERVICE" in bold lettering. Front face 40 may include other text as required by city code such as "DO NOT REMOVE THIS TAG FOR ANY REASON". Front face 40 is about 9 by 9 inches. Although shown as square or rectangular in shape, notice tag 20 may be circular, triangular, polygon, or any other geometric shape designed to be noticed and convey information. Front face 40 has opening 42 which is sized to easily slide over the hose fitting of fire hydrant 22. In one embodiment, opening 42 is 4⅝ inches in diameter. Other sizes, shapes, and designs for notice tag 20 are within the scope of the present invention.

Notice tag 20 further includes side panels 26 and 28 disposed on either side of the tag. Side panels 26-28 are each about 2 by 9 inches and formed integral to front face 40. Side panels 26-28 are formed at angle 44 with respect to a side of front face 40 which faces fire hydrant 22. In one embodiment, angle 44 is selected between 90 and 120 degrees. Assuming fire hydrant 22 is located a few feet from the edge of the street, angle 44 is selected to provide a good line of sight visibility of the side panels of notice tag 20 to approaching traffic. Since traffic usually approaches at an increasing angle with respect to side ports 32 and 34, in one embodiment, angle 44 is made greater than 90°. Moreover, an angle 44 greater than 90° also makes volume quantities of notice tag 20 more easily stackable for shipping and storage.

Side panels 26-28 further include strips 46 to make the notice tag more visible. In one embodiment, the background of side panels 26-28 are white and strips 46 are red on the white background. Other colors, shapes, and designs for application to side panels 26-28 are within the scope of the present invention. For example, side panels 26-28 may be checkerboard, cross-hatch, dotted, or any other designs and geometric shapes which are readily visible and observable to on-coming traffic. Side panels 26-28 may be embossed or fixed with reflective tape or luminescent material. The reflective tape make the side panels particularly noticeable at night from the headlights of the approaching vehicle. The reflective tape will reflect light back to the on-board crew in their line of sight. Side panels 26-28 become recognizable to emergency crews to save them time in knowing that the subject fire hydrant is out of service.

Figure 11:
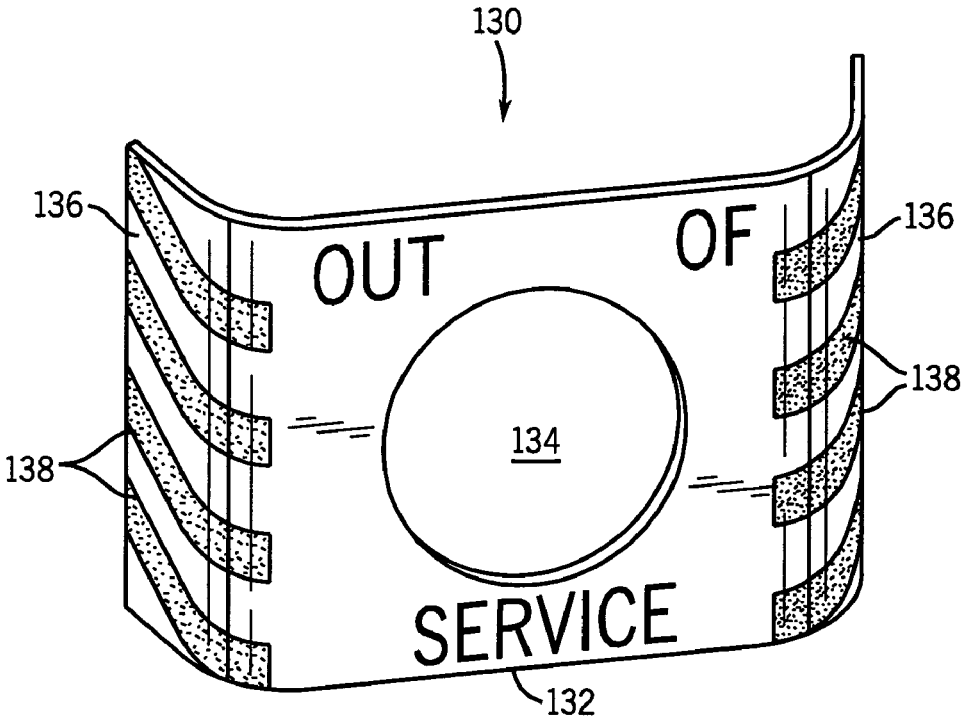
FIG. 11 illustrates a notice tag with front face gradually molded into side panels.

To manufacture notice tag 20, a blank plate is stamped or printed with the relevant information. An opening is cut into the plate to fit over the hose fitting of the fire hydrant. The plate is heated and pressed to bend side panels 26-29 to the desired angle. As shown in FIG. 11, the plate may be bent to form a gradually increasing angle or curve from the front face to the side panels of the notice tag.

Figure 5:
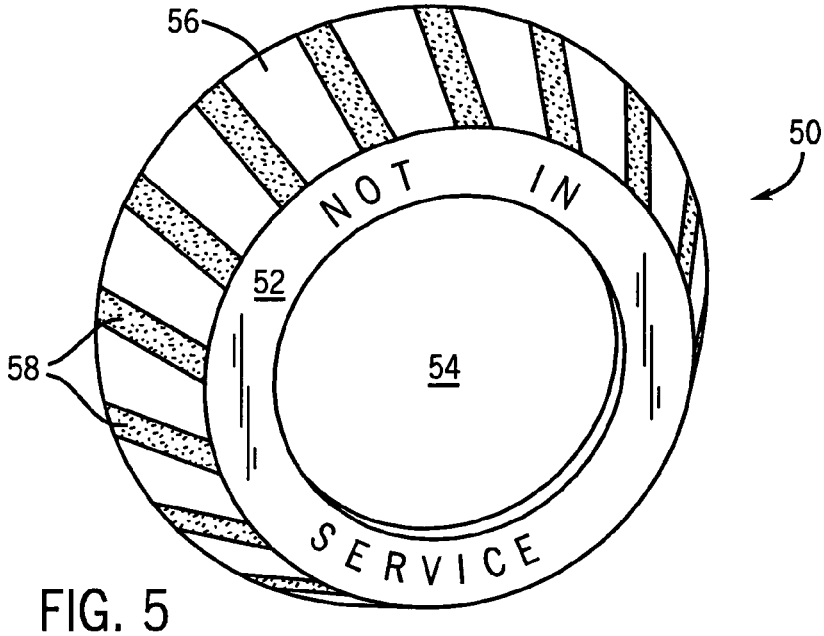
FIG. 5 illustrates a circular notice tag with side panels around the circumference of the tag.
Figure 6:
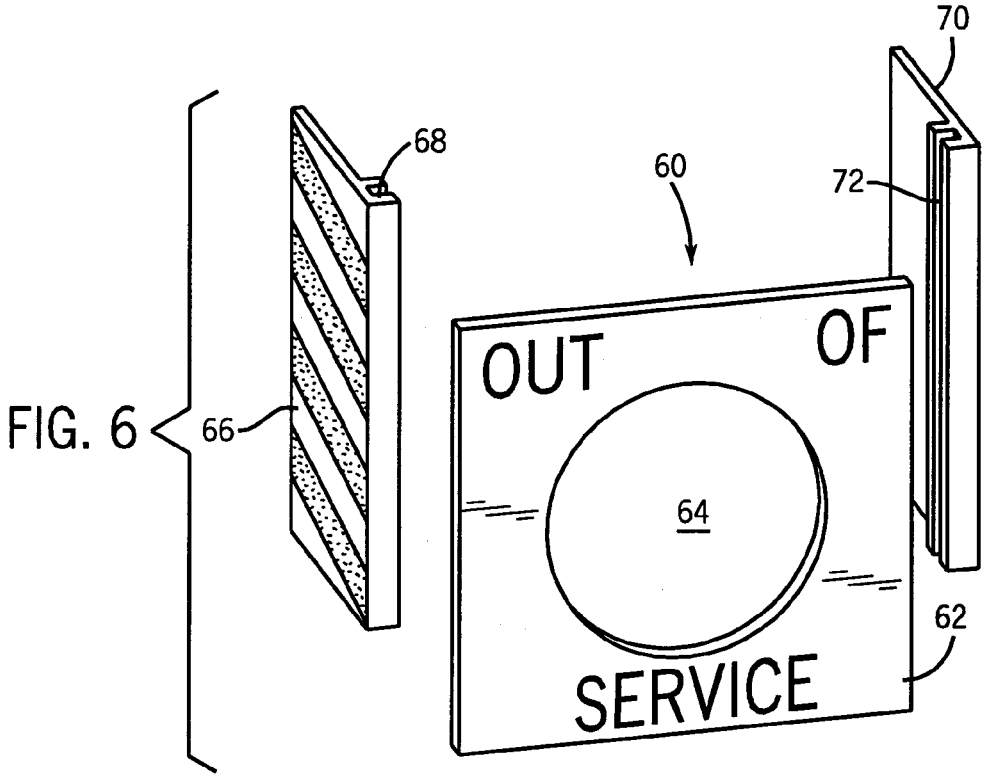
FIG. 6 illustrates a notice tag with attachable side panels.

Turning to FIG. 5, notice tag 50 is shown with circular shape. Notice tag 50 includes face 52 and opening 54 similar to the description in FIG. 4. Notice tag 50 has a side portion 56, which extends around the circumference of the tag. Side portion 56 is made with a similar angle (like angle 44) with respect to the backside of face 52 for optimal viewing in the line of sight of the approaching traffic. Side portion 56 has a pattern, such as red strips 58 on white background as described above. Side portion 56 is visible from side viewing angles and can be seen from all orientations of notice tag 50. It is possible in some situations for side panels 26-28 of notice tag 20 to become difficult to see, e.g., if the notice tag is not installed with the proper vertical orientation, or if the notice tag becomes misaligned while mounted to the fire hydrant such that the side panels are no longer vertical. Side portion 56 around the circumference of notice tag 50 makes the tag visible from both sides of the fire hydrant, for all orientations of the tag with respect to the hose fitting.

In another embodiment, the water departments and fire departments may use notice tag 60 which comprises a flat rectangular card 62 having an opening 64. The "OUT-OF-SERVICE" notice is printed on the face of card 62. Side panel 66 having edge channel 68 is attached with a clip, adhesive, or pressure fit over one edge of card 62. Side panel 70 having edge channel 72 is attached with a clip, adhesive, or pressure fit over the other edge of card 62. The combination of card 62 and attachable side panels 66 and 70 make up the totality of the notice tag with side panels which are viewable from either side of the fire hydrant in the line of sight of the on-coming traffic.

Figure 7:
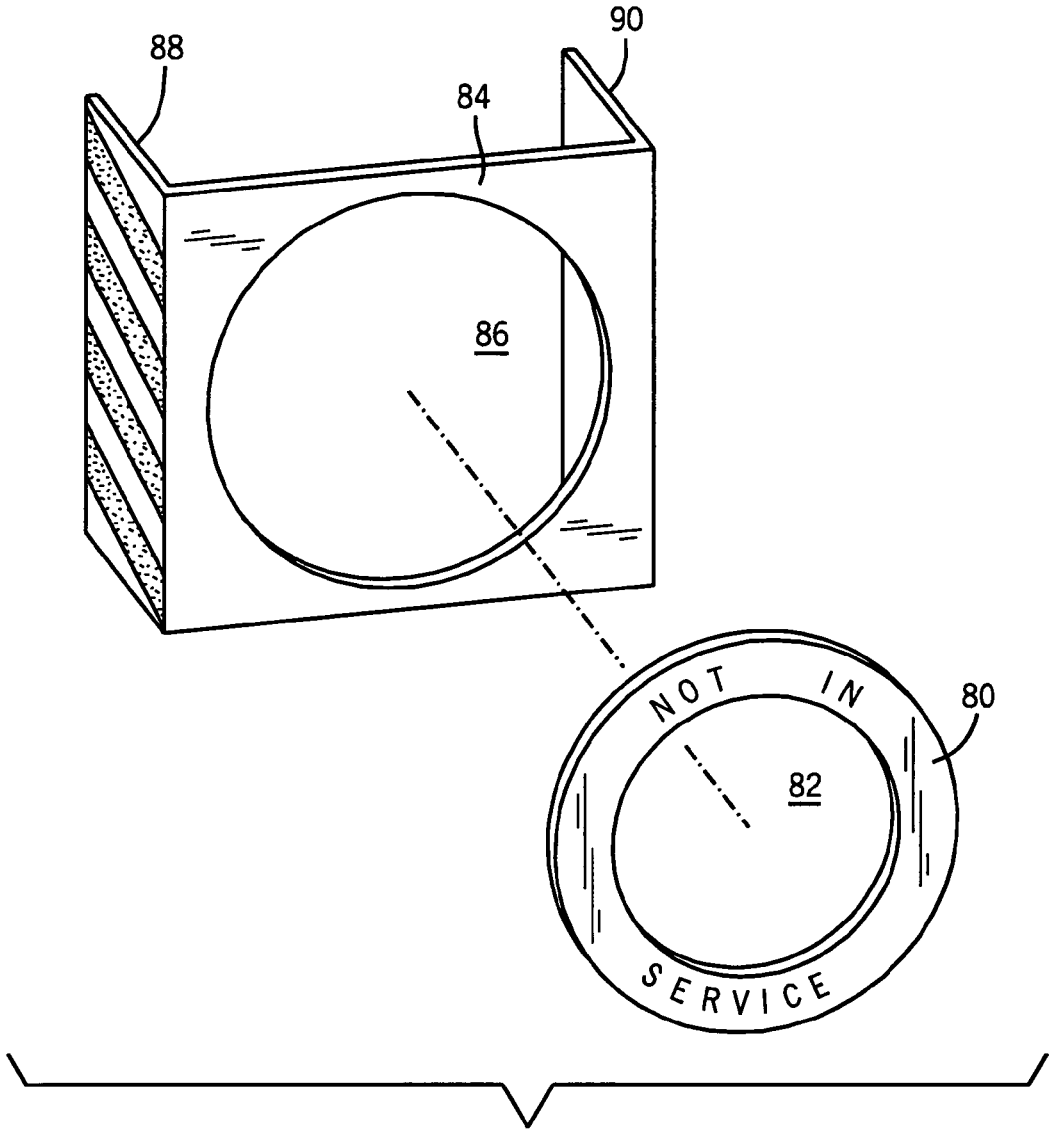
FIG. 7 illustrates a notice tag combined with separate card having side panels.

FIG. 7 illustrates a circular ring 80 with opening 82 and the "NOT IN SERVICE" notice printed on its face. Tag 84 has opening 86 and side panels 88 and 90. Tag 84 typically has no text on its face. Tag 84 and notice ring 80 are both placed over the hose fitting of the fire hydrant and locked in place with the fitting cap. The combination of notice ring 80 and tag 84 with panels 88 and 90 make up the totality of a notice tag with side panels which are viewable from either side of the fire hydrant by on-coming traffic.

Figure 8:
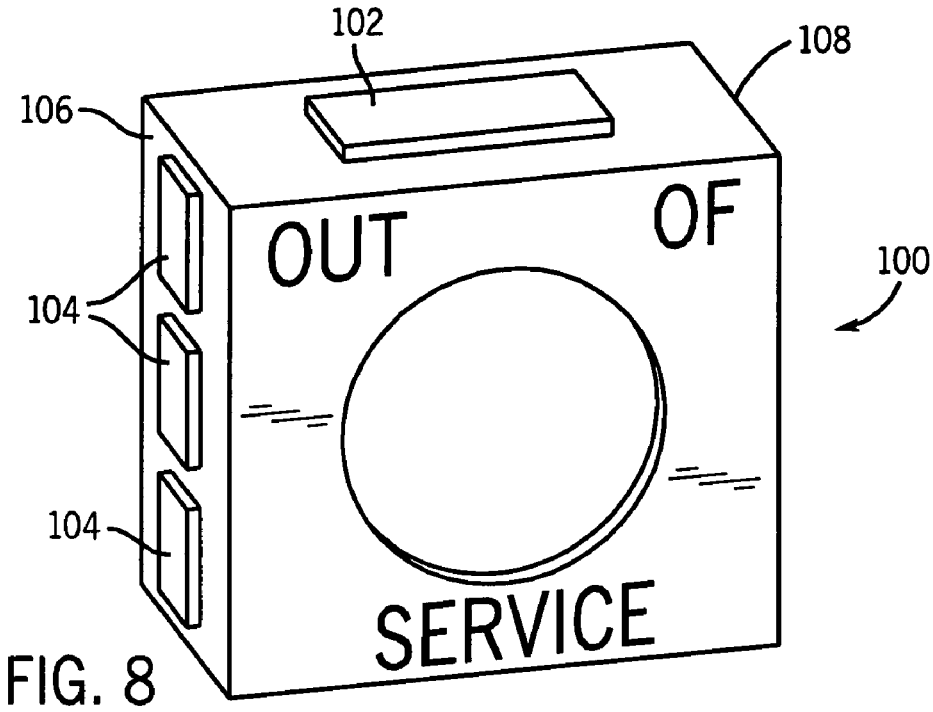
FIG. 8 illustrates a notice tag with a source of light on the side panels.

Notice tag 100 in FIG. 8 represents an electronic embodiment of the notice tag. Notice tag 100 include energy source and electronic module 102. The energy source may be battery or solar cells. The electronic module provides electrical signals to light indicators 104 mounted on side panels 106 and 108. The light indicators 104 may be steady-on, flashing, blinking, or rotate in sequence to provide high visibility of notice tag 100 from both sides of the fire hydrant, particularly during night hours.

Figure 9:
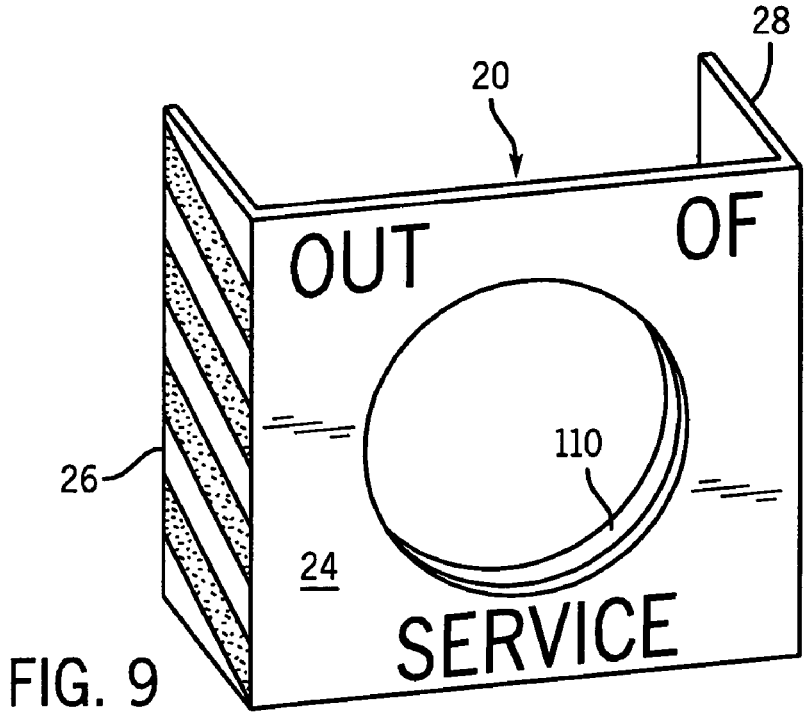
FIG. 9 illustrates a notice tag with a lip around the opening for holding the tag in place.

In FIG. 9, notice tag 20 is shown with an edge or lip 110 around the circumference of the opening. Lip 110 may be ⅛ inch greater width than the thickness of notice tag 20. Lip 110 provides a pressure fit of the notice tag to the hose fitting on the fire hydrant.

Figure 10:
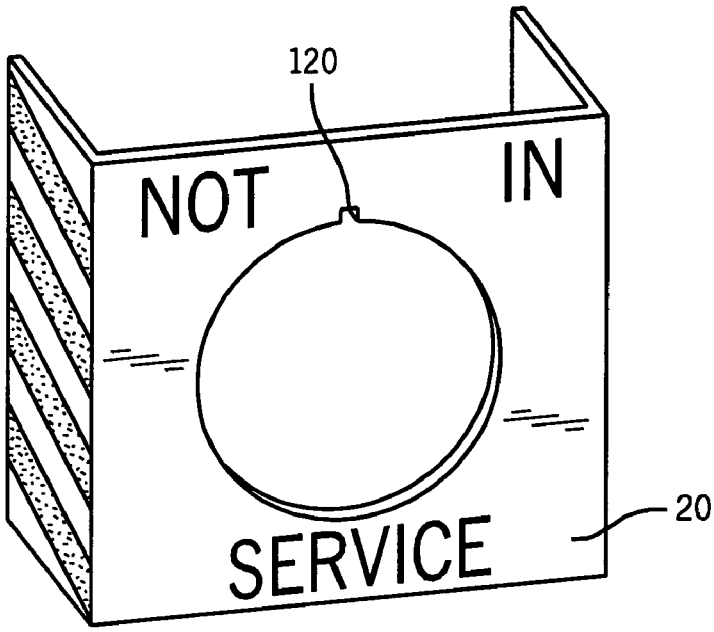
FIG. 10 illustrates a notice tag with a key in the opening for holding the tag in place.

In FIG. 10, the opening in notice tag 20 includes a key notch 120, which aligns with similar shaped portion of the hose fitting of the fire hydrant. The key notch 120 insures that notice tag 20 is aligned and oriented properly when mounted to the hose fitting, and further that it does not become misaligned while in service.

In another embodiment, notice tag 130 has front face 132 with "OUT OF SERVICE" notice as shown in FIG. 11. An opening 134 is formed in front face 132. Side panels 136 are integrated or molded over a gradually increasing angle with front face 132. Side panels 136 finish with an angle greater than 90° with respect to the backside (fire hydrant side) of front face 132. In this embodiment, the transition from front face 132 to side panels 136 is gradual or curved. Side panels 136 include strips 138 which are imprinted around and along the curved surface of the side panels. The strips on side panels 136 are visible for easy observation from approaching traffic. Side panels 136 may continue completely around the circumference of front face 132, similar to that shown in FIG. 5.

The optimal line of sight viewing angle from the fire truck to the fire hydrant changes as the vehicle approaches. The curved feature of strips 138 on side panels 136 provide the advantage of being visible from almost any viewing angle. When the fire truck is farther away, the area A of side panels 136 is more visible in the line of sight of the on-board crew. As fire truck nears fire hydrant 22, the area B of side panels 136 is more in their line of sight. Each area around the curved surface of side panels 136 is in the optimal line of sight depending on the distance from the truck to the fire hydrant. In each case, the curved feature of side panels 136 makes for line of sight observation of the notice tag from almost any viewing angle for an approaching vehicle.

The notice tag can be used in a number of applications. The notice tag can be placed on emergency phones along roadways, utility boxes, and other fixtures where it is important or useful to detect an out-of-service condition from side viewing angle.

While one or more embodiments of the present invention have been illustrated in detail, the skilled artisan will appreciate that modifications and adaptations to those embodiments may be made without departing from the scope of the present invention as set forth in the following claims.

What is claimed is:

1. A notice tag for marking a fire hydrant as being out-of-service, comprising a rectangular tag having a flat portion with an opening adapted for mounting over a hose fitting of the fire hydrant, and further having side panels formed from first and second sides of the tag at an angle greater than 90 degrees with respect to a side of the flat portion facing the fire hydrant, wherein the side panels are marked for visibility from a line of sight substantially normal to the side panels.

2. The notice tag of claim 1, wherein the flat portion of the notice tag includes a written out-of-service notice.

3. The notice tag of claim 1, wherein the flat portion of the notice tag includes a colored background.

4. The notice tag of claim 1, wherein the opening of the flat portion of the notice tag includes a lip.

5. The notice tag of claim 1, wherein the side panels are marked with a geometric shape.

6. The notice tag of claim 1, wherein the side panels are marked with red strips on a white background.

7. A method for manufacturing a notice tag for marking a fire hydrant as being out-of-service, comprising:

providing a rectangular tag having a flat portion with an opening adapted for mounting over a hose fitting of the fire hydrant; and forming side panels from first and second sides of the tag at an angle greater than 90 degrees with respect to a side of the flat portion facing the fire hydrant, wherein the side panels are marked for visibility from a line of sight substantially normal to the side panels.

8. The method of claim 7, wherein the flat portion of the notice tag includes a written out-of-service notice.

9. The method of claim 7, wherein the flat portion of the notice tag includes a colored background.

10. The method of claim 7, wherein the side panels are marked with a geometric shape.

11. The method of claim 7, wherein a shape of the front portion is selected from a group comprising rectangular, circular, triangular, and polygonal.

* * * * *